US006520741B1

(12) United States Patent
Phillipsen et al.

(10) Patent No.: US 6,520,741 B1
(45) Date of Patent: Feb. 18, 2003

(54) TURBOMACHINE BLADE

(75) Inventors: Bent Phillipsen, Baden-Rütihof (CH); Boris Mamaev, Moscow (RU); Evgeny Ryabov, Samara (RU)

(73) Assignee: ABB Turbo Systems AG, Baden (CH)

( * ) Notice: Subject to any disclaimer, the term of this patent is extended or adjusted under 35 U.S.C. 154(b) by 0 days.

(21) Appl. No.: 09/937,316

(22) PCT Filed: Mar. 23, 2000

(86) PCT No.: PCT/CH00/00171

§ 371 (c)(1),
(2), (4) Date: Nov. 13, 2001

(87) PCT Pub. No.: WO00/57030

PCT Pub. Date: Sep. 28, 2000

(30) Foreign Application Priority Data

Mar. 24, 1999 (DE) ..... 199 13 265

(51) Int. Cl.[7] ..... F01D 25/04

(52) U.S. Cl. ..... 416/195; 416/196 R; 416/231 R; 416/500

(58) Field of Search ..... 416/194, 195, 416/196 R, 231 R, 231 B, 500

(56) References Cited

U.S. PATENT DOCUMENTS

| | | | | |
|---|---|---|---|---|
| 4,191,508 A | * | 3/1980 | Kuroda et al. | 416/196 R |
| 4,268,223 A | * | 5/1981 | Anner et al. | 416/196 R |
| 5,267,834 A | | 12/1993 | Dinh et al. | |

FOREIGN PATENT DOCUMENTS

| | | |
|---|---|---|
| DE | 393333 | 4/1924 |
| DE | 2525043 | 1/1976 |
| DE | 4229769 A1 | 3/1994 |
| FR | 1252766 | 12/1960 |
| FR | 2381905 | 9/1978 |

* cited by examiner

*Primary Examiner*—Edward K. Look
*Assistant Examiner*—Ninh Nguyen
(74) *Attorney, Agent, or Firm*—Burns, Doane, Swecker & Mathis, L.L.P.

(57) ABSTRACT

The object of the invention is to improve the efficiency of a turbomachine blade provided with a reinforced hole for accommodating a damping element. To this end, the raised end faces (12, 13) of the marginal region (11), reinforced toward the hole (10), of the blade body (4) are formed with an acute angle (α) open toward the leading edge (5) of the blade body (4) and/or with an acute angle (β) open toward the blade tip (9).

3 Claims, 1 Drawing Sheet

Fig. 1
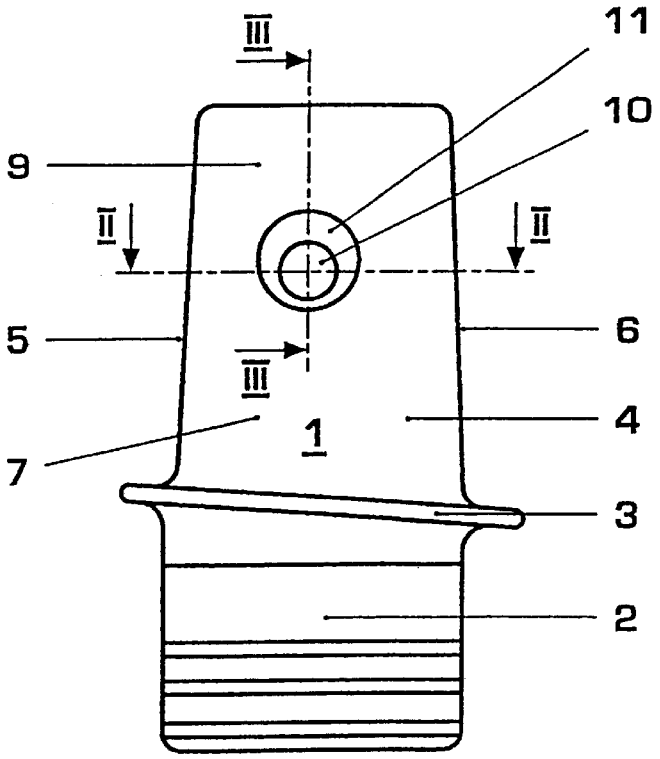
Fig. 3
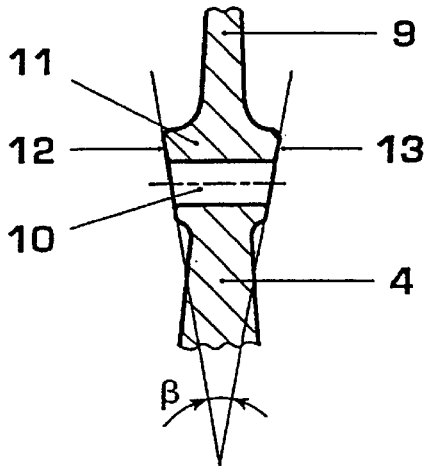
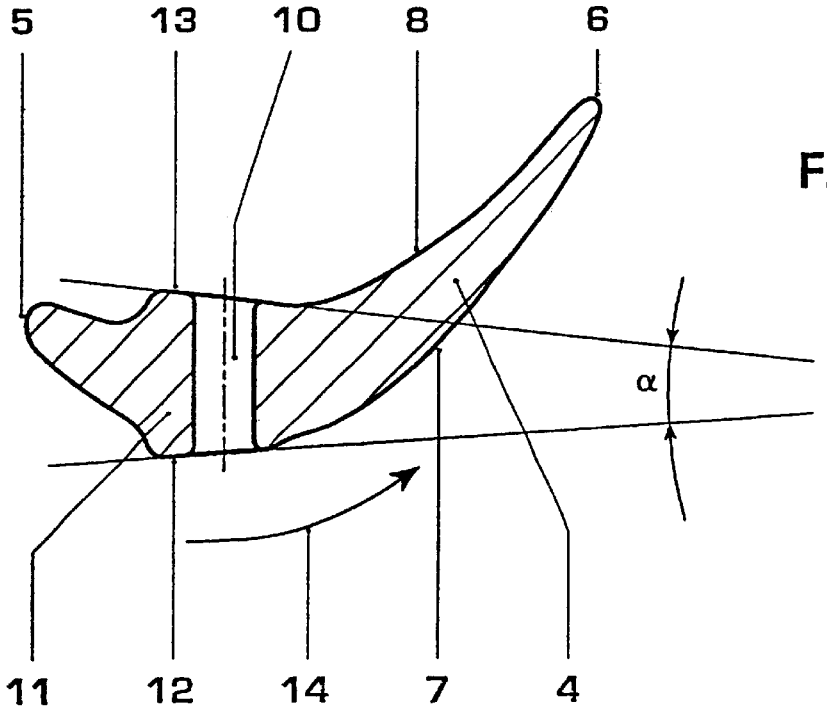
Fig. 2

TURBOMACHINE BLADE

TECHNICAL FIELD

The invention relates to a turbomachine blade provided with a damper-wire hole according to the preamble of claim 1.

PRIOR ART

In order to avoid inadmissible vibrations of the blades of turbomachines, damper wires or other damping elements, which are accommodated in corresponding holes of the blades, are often used. As a result of the high revolutions, however, increased stresses occur, in particular at the hole margins.

To prevent premature material fatigue, it is known to provide appropriate reinforcement in the hole region of the blades. The contact region between the damper wire and the damper-wire hole during operation of the turbomachine is defined by the distance between the boundary planes of the reinforcement. In this case, this distance, or the length of the contact region, is selected in such a way that both sufficient static strength and dynamic strength is ensured.

However, a problem with such reinforcement of the hole region is the fact that any reinforcement causes a disturbance of the flow in the region of the damper wire and thus reduces the efficiency of the blading. At the same time, the reduction in the efficiency is all the greater, the larger the design of the reinforcement.

SUMMARY OF THE INVENTION

The object of the invention, in attempting to avoid all these disadvantages, is to improve the efficiency of a turbomachine blade which has a reinforced hole for accommodating a damping element.

According to the invention, this is achieved in that, in a device according to the preamble of claim 1, the raised end surfaces of the blade-body marginal region reinforced toward the hole are formed with an acute angle $\alpha$ open toward the leading edge of the blade body and/or with an acute angle $\beta$ open toward the blade tip.

The end faces of the reinforced marginal region thus converge in the direction of the blade trailing edge and in the direction of the blade root, so that the size of the reinforced marginal region decreases in the main flow direction of the working fluid. As a result, a turbomachine blade of aerodynamically favorable design in t he region of the hole and having an improved efficiency is obtained.

The two acute angles $\alpha$ and $\beta$ are preferably formed within a range of 5° to 30°. It has been found that, with such a configuration, very little disturbance of the flow occurs in the region of the damping elements.

BRIEF DESCRIPTION OF THE DRAWING

An exemplary embodiment of the invention is shown in the drawing with reference to a moving blade of the exhaust-gas turbine of a turbocharger. In the drawing:

FIG. 1 shows a suction-side side view of the moving blade;

FIG. 2 shows a section through the moving blade along line II—II in FIG. 1;

FIG. 3 shows a section through the moving blade along line III—III in FIG. 1.

Only the elements essential for the understanding of the invention are shown. Elements not shown are, for example, the other components of the exhaust-gas turbine, including the blade wheel.

WAY OF IMPLEMENTING THE INVENTION

The turbomachine blade shown in FIG. 1 and designed as a moving blade 1 consists of a blade root 2, a platform 3 and a blade body 4. The platforms of adjacent turbine blades of the turbine wheel (not shown) bear directly against one another and thus form the inner boundary of the flow duct, which is closed on the outside by a blade shroud (likewise not shown). The blade body 4 has a leading edge 5, a trailing edge 6, a suction side 7, a pressure side 8 and a blade tip 9.

Arranged in the blade body 4 is a hole 10 which passes from the suction side 7 through to the pressure side 8 and is intended for accommodating a damper wire (not shown) which reduces the blade vibrations occurring during operation. In addition, the blade body is formed with a marginal region 11 reinforced toward the hole 10, the marginal region 11, on both the suction side 7 and the pressure side 8, having an end face 12, 13 raised relative to the blade body 4. The end faces 12, 13 are formed with an acute angle $\alpha$ of about 10° open toward the leading edge 5 of the blade body 4 and with an acute angle $\beta$ of about 20° open toward the blade tip 9 (FIG. 2, FIG. 3).

The two end faces 12, 13 of the reinforced marginal region 11 therefore converge in the direction of the trailing edge 6 of the blade body 4 and in the direction of the blade root 2 in such a way that the reinforcement of the trailing-side part and the blade-root-side part of the marginal region 11 is designed to be distinctly less than the reinforcement of the leading-side part and the blade-tip-side part of the marginal region 11.

This design of the blade body 4 in the region of the hole 10 results in improved flow guidance during operation of the turbocharger or the exhaust-gas turbine. In particular, the working medium flowing along the blade body 4 in the main flow direction 14, as a result of the end faces 12, 13 arranged at an acute angle to one another as described above, is subjected to markedly less disturbance than is the case with the solutions according to the prior art. On account of the improved flow guidance in the region of the turbine wheel, a higher efficiency of the turbocharger and thus ultimately also of the internal combustion engine connected to the turbocharger can be achieved.

Depending on the design of the blade body 4 and in accordance with the conditions of use of the turbocharger, it has been found that the angles $\alpha$ and $\beta$ between the end faces 12, 13 of the reinforced marginal region 11 are in each case advantageously formed within a range of 5° to 30°.

Of course, the end faces 12, 13 may also have only one of the two acute angles $\alpha$, $\beta$ (not shown), a factor which certainly simplifies the production but constitutes a certain loss of efficiency.

Of course, such a design of the reinforcement of the marginal region of the hole accommodating the damper wire may be used for all types of damping elements, such as, for example, in the case of binding wires, bolts, etc., and also in the case of so-called zigzag bindings.

LIST OF DESIGNATIONS

1 Turbomachine blade, moving blade
2 Blade root
3 Platform
4 Blade body
5 Leading edge

6 Trailing edge
7 Suction side
8 Pressure side
9 Blade tip
10 Hole
11 Marginal region
12 End face
13 End face
14 Main flow direction

What is claimed is:

1. A turbomachine blade having a blade body which has a leading edge, a trailing edge, a suction side, a pressure side and a blade tip and is provided with a through-hole for accommodating a damping element for the blade vibrations, the blade body being formed with a marginal region reinforced toward the hole, and the marginal region having a raised end face on both the suction side and the pressure side, wherein the end faces are formed with an acute angle ($\alpha$) open toward the leading edge of the blade body and/or with an acute angle ($\beta$) open toward the blade tip.

2. The turbomachine blade as claimed in claim 1, wherein the angle a is formed within a size range of $5° \leqq \alpha < \leqq 30°$.

3. The turbomachine blade as claimed in claim 1, wherein the angle $\beta$ is formed within a size range of $5° \leqq \beta \leqq 30°$.

* * * * *